US006430977B1

(12) United States Patent
Berstis et al.

(10) Patent No.: US 6,430,977 B1
(45) Date of Patent: Aug. 13, 2002

(54) INTEGRATED KEYSLOT

(75) Inventors: Viktors Berstis, Austin; Michael A. Paolini, Round Rock, both of TX (US)

(73) Assignee: International Business Machines Corp., Armonk, NY (US)

( * ) Notice: Subject to any disclaimer, the term of this patent is extended or adjusted under 35 U.S.C. 154(b) by 0 days.

(21) Appl. No.: 09/522,198

(22) Filed: Mar. 9, 2000

(51) Int. Cl.[7] ..... E05B 11/00

(52) U.S. Cl. ..... 70/63; 70/276; 70/389; 70/456 R; 232/19

(58) Field of Search ..... 70/276, 399, 456 R, 70/63, 389, 429, 430; 232/19

(56) References Cited

U.S. PATENT DOCUMENTS

| | | | | | |
|---|---|---|---|---|---|
| 11,412 | A | * | 8/1854 | Cayce | 70/399 |
| 698,326 | A | * | 4/1902 | Schwab | 70/134 |
| 1,170,291 | A | * | 2/1916 | Link | |
| 1,592,637 | A | * | 7/1926 | Macri | 70/134 |
| 1,596,336 | A | * | 8/1926 | Claassen | 70/134 |
| 1,649,424 | A | * | 11/1927 | Tirone | 70/134 |
| 1,797,489 | A | * | 3/1931 | Wemhoener | |
| 3,084,008 | A | | 4/1963 | Mallett | 312/319 |
| 4,296,617 | A | | 10/1981 | Campagna | 70/63 |
| 4,615,281 | A | | 10/1986 | Gaston | 109/50 |
| 4,641,509 | A | | 2/1987 | Batchelor et al. | 70/388 |
| 5,346,066 | A | * | 9/1994 | Jones | 70/456 R X |

FOREIGN PATENT DOCUMENTS

| | | | | |
|---|---|---|---|---|
| DE | 333695 | * | 3/1921 | 70/134 |
| DE | 344817 | * | 12/1921 | 70/399 |
| DE | 390215 | * | 2/1924 | 70/399 |
| DE | 3235322 | * | 3/1984 | 70/276 |
| FR | 968940 | * | 12/1950 | 70/134 |
| FR | 2597140 | * | 10/1987 | 70/455 |

* cited by examiner

*Primary Examiner*—Lloyd A. Gall
(74) *Attorney, Agent, or Firm*—Kevin L. Daffer; Conley, Rose & Tayon P.C.; Marilyn S. Dawkins, IBM

(57) ABSTRACT

An integrated keyslot makes it possible to secure a door key immediately after locking a door. Upon leaving the premises and locking the door, the key is deposited in the keyslot. In an embodiment, a chute connects the keyslot to a receptacle on the interior surface of the door, which retains the key until it can be retrieved by the owner. The method and system described herein are believed to be advantageous in providing greater security to premises. As an example, maintenance personnel could be given a key with which they could visit a home to perform repairs. Immediately upon leaving, they would lock the door and deposit the key in the integrated keyslot, thus protecting the owner against loss or theft of the key.

12 Claims, 1 Drawing Sheet

INTEGRATED KEYSLOT

BACKGROUND OF THE INVENTION

1. Field of the Invention

This invention is related to the field of lock mechanisms and, more particularly, to lock mechanisms with key storage.

2. Description of the Related Art

There are many situations calling for limited access to a home or business, for example, by custodial or repair persons. Often, one-time access may be all that is required. However, giving out a key typically grants unlimited entry and, therefore, compromises security. It would be desirable to have a means of securing the key following access to premises by designated persons.

Related prior art exists pertaining to secure storage and retrieval of a key. In many such systems the key is held in a key safe integrated into the door, from which the key may later be retrieved by means of a master key or externally accessible combination lock. U.S. Pat. No. 3,084,008 to Mallet, for instance, describes a type of key safe useful for real estate agents, in which a house key is kept within a key safe attached to the door of the house. The key safe is opened by means of a master key (obtained from the realtor) and the house key is tethered to the safe, so it cannot be removed from the premises. However, this invention is obviously not suitable for situations in which it is necessary to loan out the key.

Another related device is described in U.S. Pat. No. 4,615,281 to Gaston, in which an electronic combination lock provides entry to a key safe within the door. This method also suffers from drawbacks that render it unsuitable for the types of use described in the preceding paragraph. In order to grant someone access to the key safe, it would be necessary to give him or her the combination. But it would then be necessary to change the combination; otherwise that individual would continue to have access to the safe after the intended period. Furthermore, loss of power would render the combination lock to the key safe inoperative, which could result in the user being locked out.

SUMMARY OF THE INVENTION

The problems outlined above are in large part solved by a locking mechanism with an integrated keyslot as described herein. The mechanism comprises a lock assembly, within which is a slot. The slot is accessible from the exterior surface of the door and connects to a chute, through which the key slides when dropped into the slot. The chute deposits the key into a receptacle on the interior surface of the door, in which it is retained until the owner can retrieve it. In one embodiment, a magnet within the receptacle serves to draw the key down the chute and capture it.

A method is also contemplated for securing a key within a door lock, such that the key may be deposited from the outside after locking the door, and is ensconced within a receptacle accessible only from the inside.

It is often necessary to loan out a key in order to grant someone limited access to a home or business. It is believed to be advantageous to have a means for safely returning the key immediately after use, thereby reducing the risk that the key could become lost or stolen.

BRIEF DESCRIPTION OF THE DRAWINGS

Other objects and advantages of the invention will become apparent upon reading the following detailed description and upon reference to the accompanying drawings in which.

Figure 1:
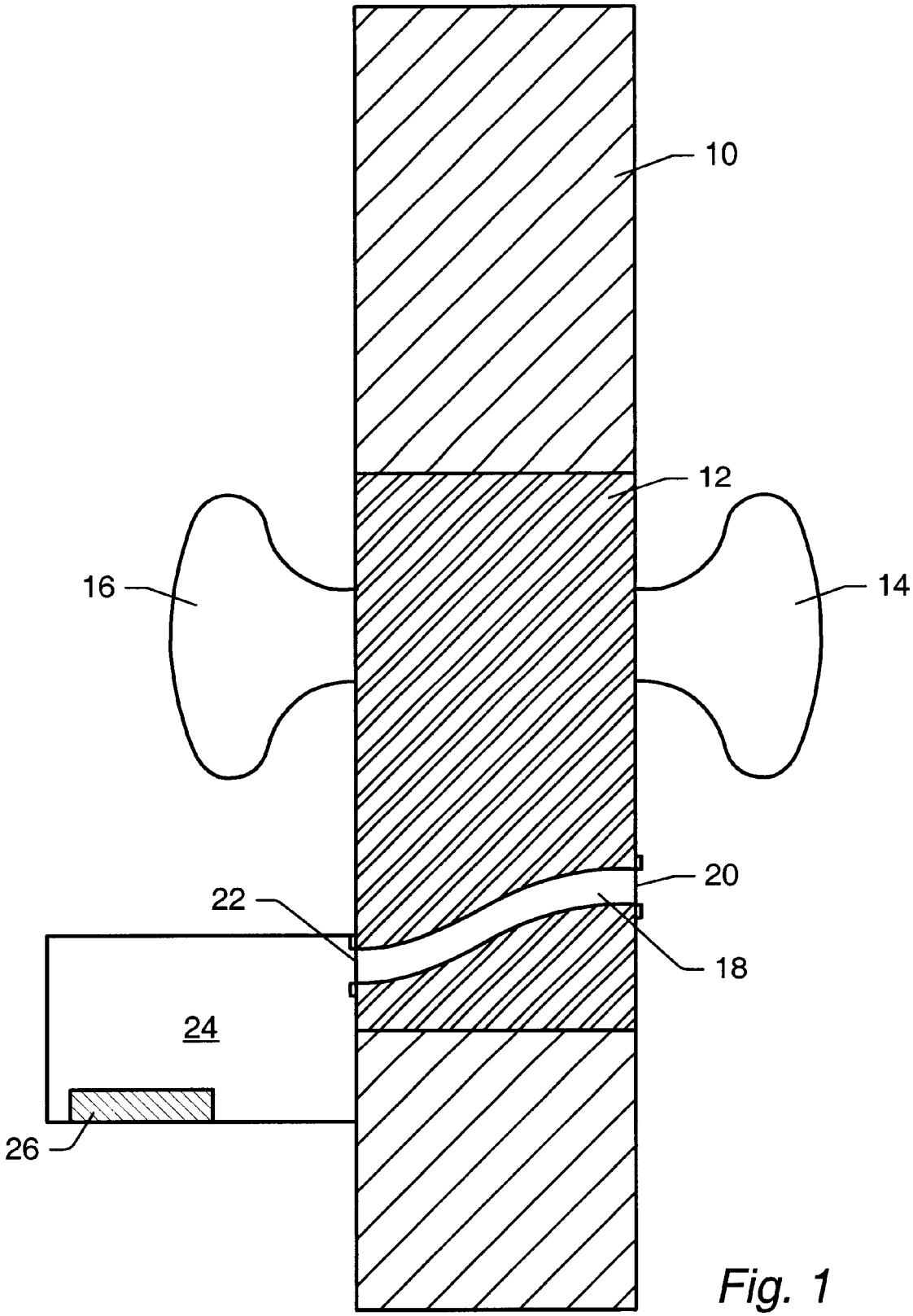
FIG. 1 section of an integrated keyslot.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning now to FIG. 1, a cross sectional view of one embodiment of an integrated keyslot is shown. Other embodiments are possible and contemplated. A door 10 is shown, along with the locking mechanism 12, the doorknob 14 on the outer surface, and the doorknob 16 on the inner surface. The locking mechanism may be any of various types of door locks, such as a key lock, or a deadbolt. A chute 18 has a slot 20 on the outer surface of the door, through which the key may be dropped. The width of the chute may be slightly larger than the thickness of the key. Therefore, the key must be inserted edgewise; more importantly, once the key is dropped into the slot it cannot be withdrawn through the chute. This insures that a deposited key cannot be stolen. An opening 22 on the other end of chute 18 allows the key to fall into a receptacle 24 on the inside surface of the door. In some embodiments, a magnet 26 in the receptacle may serve to draw the key down the chute. Other embodiments may include a flap or seal over slot 20, to exclude moisture from chute 18 and key receptacle 24. Receptacle 24 may have a lid that can be opened to allow subsequent retrieval of the key. The chute 18 is preferably situated beneath the doorknob, so that the slot 20 and receptacle 24 are in a convenient location. In a preferred embodiment, the slot, chute and receptacle are made of metal or a durable plastic and are integrated with the locking mechanism, so they may be conveniently installed along with the lock.

It will be appreciated by those skilled in the art having the benefit of this disclosure that this invention is believed to present a system and method for implementing an integrated keyslot. Further modifications and alternative embodiments of various aspects of the invention will be apparent to those skilled in the art in view of this description. It is intended that the following claims be interpreted to embrace all such modifications and changes and, accordingly, the specification and drawings are to be regarded in an illustrative rather than a restrictive sense.

What is claimed is:

1. A method for securing a key, comprising:

depositing the key in a slot in the exterior surface of a door, wherein the slot is dimensioned to prevent retrieval of the key through the slot once deposited; and temporarily retaining the key in a receptacle on the inside surface of the door.

2. The method as recited in claim 1, wherein the key is conveyed from the slot to the receptacle through a chute.

3. The method as recited in claim 1, wherein the key is retained within the receptacle by a magnet.

4. The method as recited in claim 1, wherein said retaining comprises retaining an entirety of the key within the receptacle.

5. A locking mechanism with integrated key storage, said mechanism comprising:

a slot on the exterior surface of a door, wherein the slot is adapted for depositing a key through the exterior surface, and wherein the slot is dimensioned to prevent retrieval of the key through the slot once deposited;

a receptacle on the inside surface of the door; and a path between the slot and the receptacle.

6. The locking mechanism as recited in claim 5, wherein the slot is dimensioned no larger than necessary to receive the key.

7. The locking mechanism as recited in claim 5, wherein the receptacle contains a magnet to retain the key.

8. The locking mechanism as recited in claim 5, wherein said path comprises an appropriately dimensioned chute connecting the slot to the receptacle.

9. The locking mechanism as recited in claim 5, wherein said slot, path and receptacle are integrated with the locking mechanism itself.

10. The locking mechanism as recited in claim 5, wherein the receptacle is adapted to allow retrieval of the key from the interior side of the door.

11. The locking mechanism as recited in claim 10, wherein the receptacle is adapted to allow retrieval of the key solely from the interior side of the door.

12. The locking mechanism as recited in claim 5, wherein the slot is continuously accessible for said depositing.

* * * * *